US008424510B2

(12) United States Patent
Lai

(10) Patent No.: US 8,424,510 B2
(45) Date of Patent: Apr. 23, 2013

(54) STRUCTURE OF FUEL ECONOMIZER

(75) Inventor: Chieh-Jung Lai, Yonghe (TW)

(73) Assignee: 101 International Co., Ltd., Taipei County (TW)

( * ) Notice: Subject to any disclaimer, the term of this patent is extended or adjusted under 35 U.S.C. 154(b) by 433 days.

(21) Appl. No.: 12/730,196

(22) Filed: Mar. 23, 2010

(65) Prior Publication Data

US 2011/0232612 A1 Sep. 29, 2011

(51) Int. Cl.
*F02M 27/00* (2006.01)

(52) U.S. Cl.
USPC ..... 123/538; 123/536; 123/537; 210/222; 210/695

(58) Field of Classification Search ..... 123/536–538; 210/222, 695
See application file for complete search history.

(56) References Cited

U.S. PATENT DOCUMENTS

| | | | | |
|---|---|---|---|---|
| 5,520,158 | A * | 5/1996 | Williamson | 123/538 |
| 5,533,490 | A * | 7/1996 | Pascall | 123/538 |
| 6,532,919 | B2 * | 3/2003 | Curtis et al. | 123/90.11 |
| 6,716,346 | B1 * | 4/2004 | Chang | 210/222 |
| 6,810,864 | B1 * | 11/2004 | Folk | 123/538 |
| 7,021,297 | B1 * | 4/2006 | Slingo | 123/536 |
| 7,281,526 | B2 * | 10/2007 | Keiichiro et al. | 123/538 |
| 7,351,337 | B1 * | 4/2008 | Milo et al. | 210/222 |
| 7,377,269 | B1 * | 5/2008 | Lai | 123/538 |
| 8,176,899 | B2 * | 5/2012 | Lee | 123/538 |
| 2005/0145225 | A1 * | 7/2005 | Ratner et al. | 123/538 |
| 2005/0284453 | A1 * | 12/2005 | Eriksson et al. | 123/538 |
| 2007/0074683 | A1 * | 4/2007 | Matsuo et al. | 123/41.01 |
| 2007/0256672 | A1 * | 11/2007 | Wang | 123/538 |
| 2009/0013976 | A1 * | 1/2009 | Mori | 123/538 |
| 2009/0020091 | A1 * | 1/2009 | Botzenhard et al. | 123/179.3 |
| 2009/0308360 | A1 * | 12/2009 | Istrati et al. | 123/538 |

* cited by examiner

*Primary Examiner* — Marguerite McMahon
*Assistant Examiner* — James Kim
(74) *Attorney, Agent, or Firm* — Leong C. Lei

(57) ABSTRACT

A fuel economizer includes a housing, at least two magnetic members having sides of the same polarity facing each other, and at least one covering member. The housing forms a primary receiving compartment and has at least one end forming an opening. The two magnetic members are positioned closed to each other with the sides thereof having the same polarity facing each other and are deposited in the primary receiving compartment. The open end of the housing is closed by the covering member to thereby form the economizer. The covering member forms apertures to allow liquid to flow through the primary receiving compartment. The housing may further forms secondary receiving compartments on opposite sides of the primary receiving compartments for receiving therein far infrared particles. When liquid flows through the housing, the liquid is acted upon by both the magnetic members and the far infrared particles.

6 Claims, 9 Drawing Sheets

STRUCTURE OF FUEL ECONOMIZER

TECHNICAL FIELD OF THE INVENTION

The present invention generally relates to a structure of fuel economizer, which contains therein magnetic members having sides of identical polarity facing each and far infrared particles to change molecule structure of water or fuel so as to activate the molecules and to offer the effects of improving power performance, increasing horsepower and torque, reducing fuel consumption, and lowering exhaust emission.

DESCRIPTION OF THE PRIOR ART

Automobiles are commonly used fossil fuel powered transportation, having a power device of internal combustion engine that consumes refined products of fossil fuel. The fuel enters the combustion chambers of the engine to form a mixed mist of fuel and air, which is then ignited or compressed to initiate combustion of the fuel for generating power. It often occurs that the fuel is not completely combusted and leads to build-up of carbon on an inside surface of a cylinder of the engine. Excessive carbon built up on the surface of the cylinder may lead to undesired emission of the carbon particles. Incomplete combustion of the fuel also leads to the generation of suspension particles of hydrocarbons, which cause pollution to the surroundings and also affects the performance of power output from the engine and may also cause severe wear of the engine. To solve such a problem of engine performance, the commonly known solutions include addition of combustion assistant agent or application of carbon removal agent. For the currently available fuel economizers, far infrared economizers attract the greatest attention.

The known far infrared economizers available in the market can be roughly divided into two types, one being mounted to a fuel inlet tube to allow the far infrared radiation emitted from the economizer to penetrate into the fuel flowing through the tube and thus making the fuel molecules minute for more complete combustion of the fuel and reduction of carbon built up. The other type is directly set the economizer in the fuel tank to directly act on the fuel contained in the fuel tank for enhancing activation of the fuel molecules.

SUMMARY OF THE INVENTION

The primary objective of the present invention is to provide a structure of economizer, which is simple for easy to manufacture and shows wide applications to effectively improve the power performance of engine, reduce fuel consumption, lower exhaust emission, and increase horsepower and torque.

Another objective of the present invention is to provide a structure of economizer that can be mounted to an external fuel supply tube to realize activation of fuel molecules when the fuel is being supplied in order to improve the combustion performance of the fuel.

To achieve the above objectives, the present invention provides a fuel economizer, which comprises a housing, at least two magnetic members having sides of the same polarity facing each other, and at least one covering member, and selectively comprises far infrared particles. The housing forms a primary receiving compartment and two secondary receiving compartments may be additionally formed in the opposite side portions of the housing. The housing has at least one end that forms an opening. The two magnetic members are positioned closed to each other with the sides thereof having the same polarity facing each other and are deposited in the primary receiving compartment, and the open end of the housing is closed by the covering member to thereby form the economizer. The secondary receiving compartments may receive therein the far infrared particles. When the economizer is positioned in a fuel tank, the magnetism of the magnetic members rearrange the fuel molecule in a regular fashion and the far infrared radiation emitted from the far infrared particles improves the activation of the gasoline molecules contained in the fuel tank, thereby effectively improving power performance when the fuel is combusted and also reducing fuel consumption, lowering exhaust emission, and increasing horsepower and torque of engine.

To connect the economizer to an external fuel supply tube or to mount the economizer to an internal fuel supply path of a vehicle engine, the covering members can be constructed to form either a coupling tube or an externally-threaded tube. With the coupling tube connected to an external fuel supply tube, when fuel is supplied to the fuel tank and/or engine, the fuel is conducted through the interior of the economizer and is acted upon by the magnetic members and the far infrared particles to be activated, whereby fuel combustion efficiency is improved. In this way, the economizer can be conveniently and easily applied to various situations.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
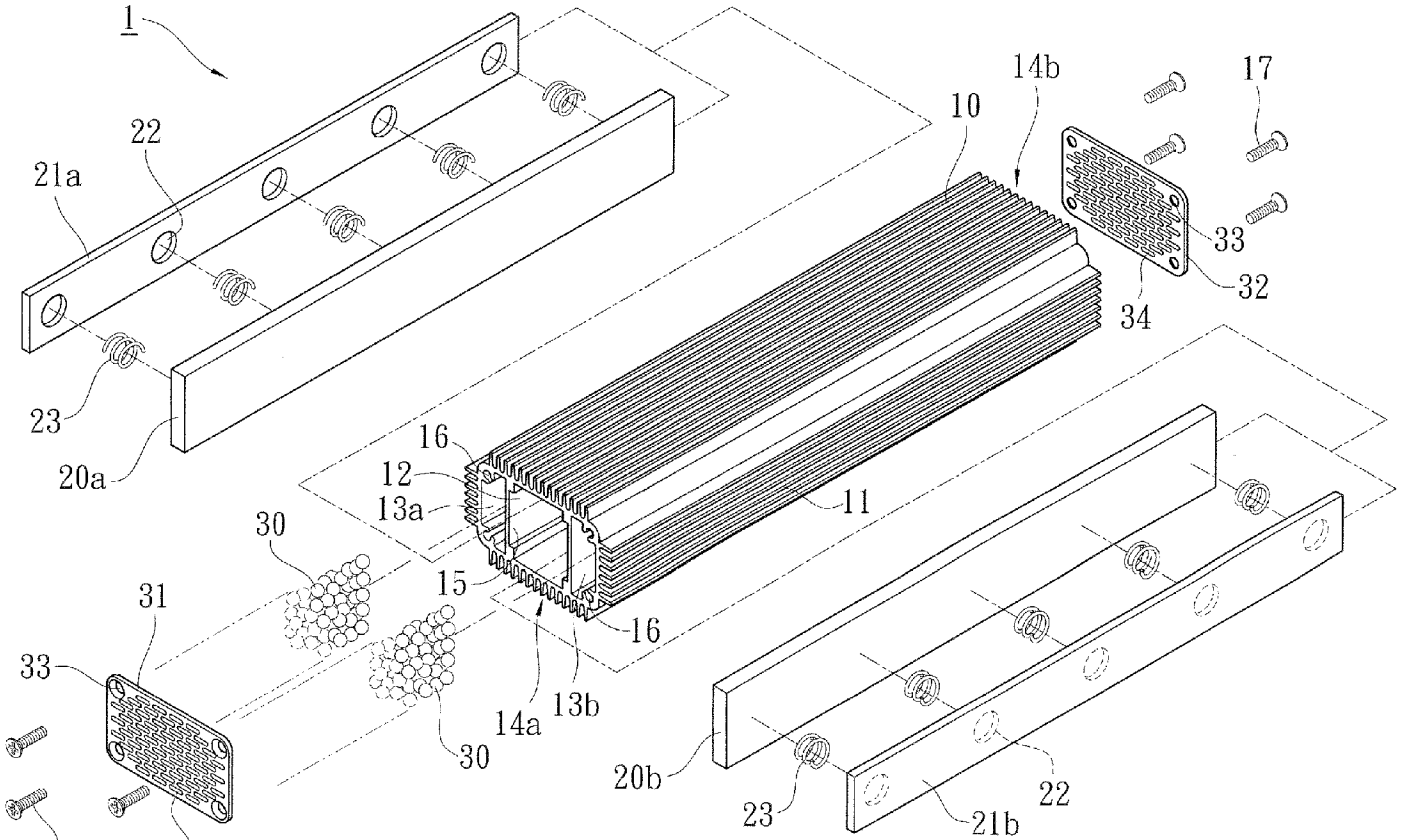
FIG. 1 is an exploded view of a fuel economizer according to an embodiment of the present invention.
Figure 2:
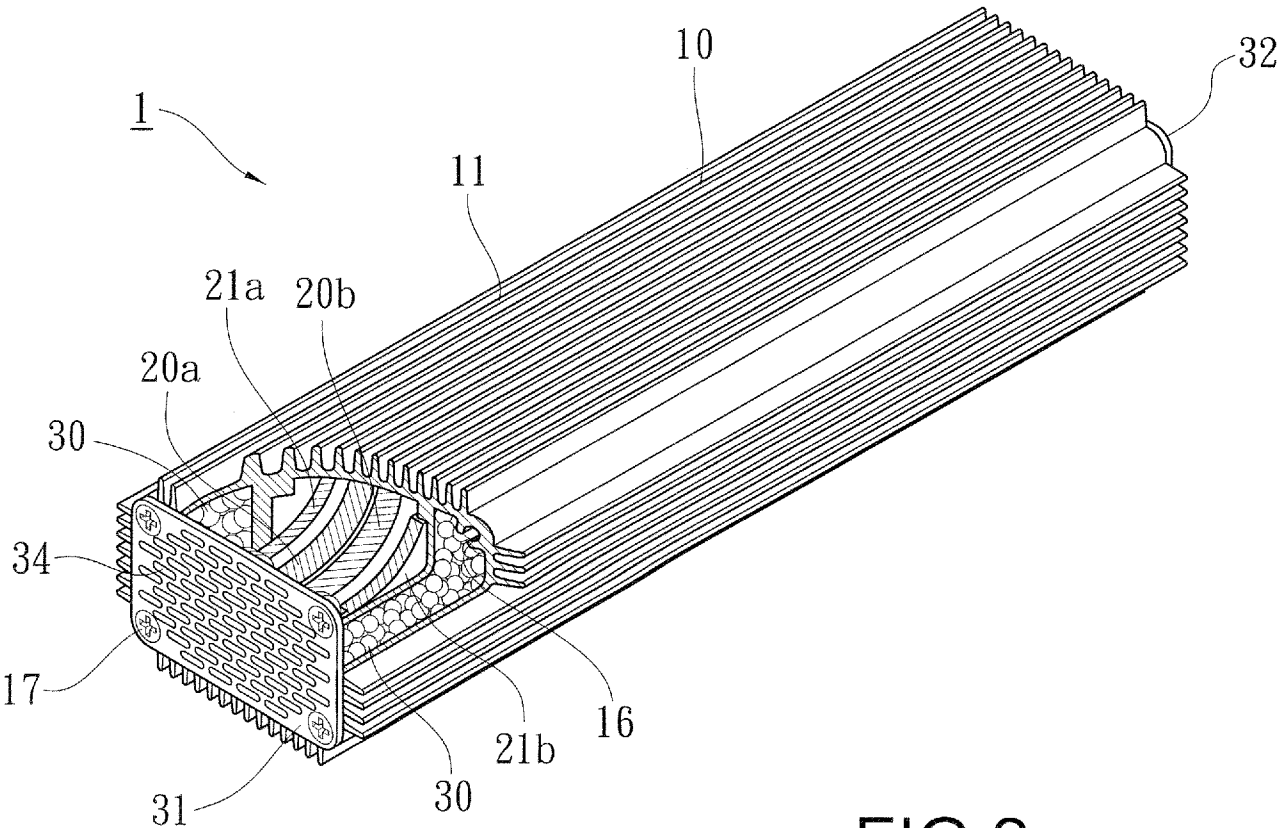
FIG. 2 is a perspective view, partially broken, of the fuel economizer according to the present invention in an assembled form.
Figure 3:
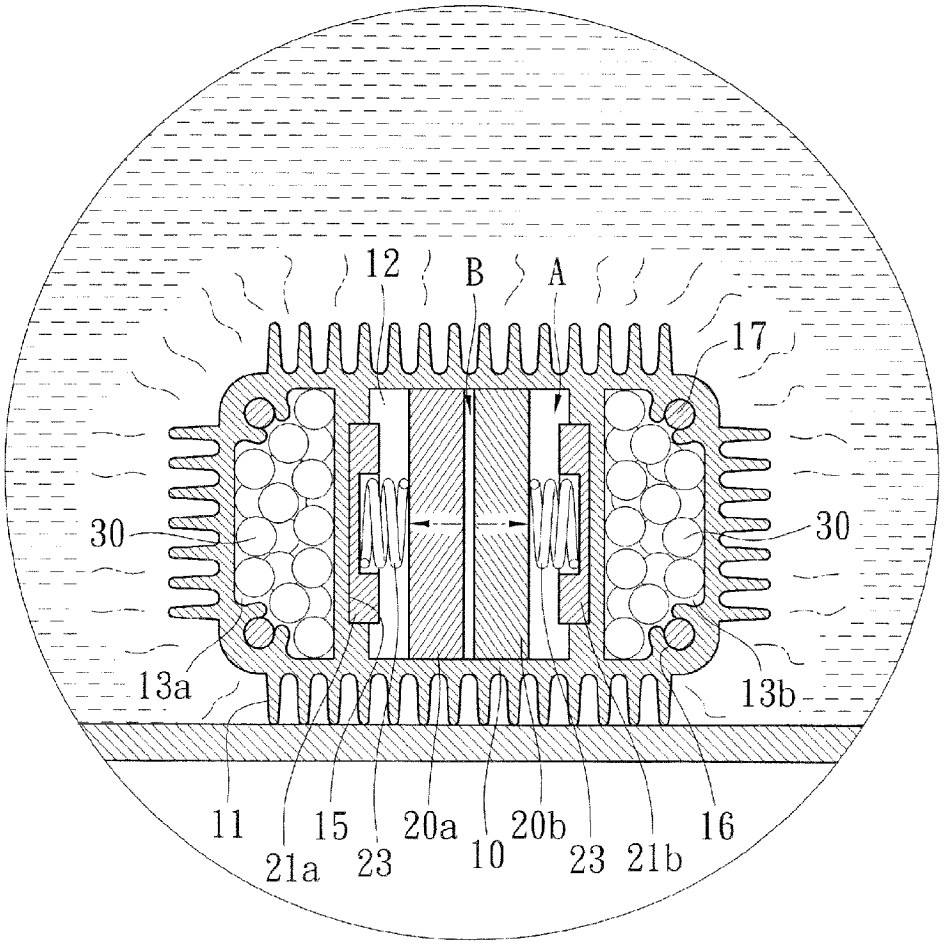
FIG. 3 is a cross-sectional view of the fuel economizer of the present invention.

Referring to FIGS. 1-3, the present invention provides a fuel economizer 1, which comprises a housing 10, two magnetic members 20*a*, 20*b*, a plurality of far infrared particles 30, and two covering members. In the instant embodiment, the housing 10 is open at both front and rear ends and thus the covering members include a front cover 31 and a rear cover 32. Alternatively, the housing is structured to have one end closed and the other end open, wherein the closed end may form apertures therein, and thus, there is only one covering member for the one end closed housing. The housing 10 has side walls having outer surfaces forming a plurality of rib-like projection structures 11, which increase contact surface of the housing 10. The housing 10 has an interior space forming a primary receiving compartment 12 and two secondary receiving compartments 13*a*, 13*b* on opposite sides of the primary receiving compartment 12. Both ends of the housing 10 respectively form openings 14*a*, 14*b*. preferably, the primary receiving compartment 12 is delimited by two opposite and spaced walls each having an inside surface that is recessed to form a slot 15. The magnetic members 20*a*, 20*b* are arranged to have the same polarity thereof facing each other. Each of magnetic members attractively holds a ferrous board 21*a*, 21*b* thereon. Each of ferrous boards forms a plurality of recessed cavities 22, each of which receives therein a resilient element 23. The magnetic members 20*a*, 20*b* which are arranged to have the same polarity sides thereof facing each other, the ferrous boards 21*a*, 21*b*, and the resilient elements 23 are positioned in the primary receiving compartment 12 in such a way that the ferrous boards 21*a*, 21*b* are respectively fit in the slots 15 (as shown in FIG. 3). The resilient elements 23 provides a force that separate each of the magnetic members 20*a*, 20*b* from the respective ferrous board 21*a*, 21*b* so as to form a space A therebetween (as shown in FIG. 3). On the other hand, due to the arrangement that the same polarity sides of the magnetic members 20*a*, 20*b* face each other, expulsion is induced between the magnetic members 20*a*, 20*b* whereby the two magnetic members 20*a*, 20*b* are separated from each other and form a space B therebetween. When a fluid passes through the interior of the housing 10, the fluid flows through both spaces A and B and is thus affected by the magnetism of the magnetic members and is also affected by far infrared particles 30, which are deposited in the secondary receiving compartments 13*a*, 13*b*. In the embodiment illustrated in the drawing, the two magnetic members are of the form of a planar board, and alternatively, the two magnetic members can be constructed to have an arc or curved configuration and arranged to have the portions thereof having the same polarity facing each other, and as such, the same result can be obtained.

Referring to FIGS. 1-3, the housing 10 forms, in each open end thereof a plurality of inner-threaded holes 16, whereby when the far infrared particles 30 are deposited into the secondary receiving compartments 13*a*, 13*b*, bolts 17 received through holes 33 defined in the front cover 31 and/or the rear cover 32 are set in threading engagement with the inner-threaded holes 16 for closing the open end(s) of the housing 10 (as shown in FIG. 2). Apertures 34 are defined in the front cover 31 and the rear cover 32, whereby when the economizer 1 is positioned in a water tank or a fuel tank, liquid is allowed to pass through the apertures 34 to enter the interior of the economizer 1 and to afterwards flow out of the economizer through the opposite end. The magnetic members 20*a*, 20*b* of the economizer change the arraying arrangement of molecules of the fluid, and the strong and fast penetration of far infrared radiation from the far infrared particles 30 into the fluids reacts with the molecules of the fuel to enhance activation of fuel molecules, allowing the fuel to be more extensively combusted and thus improving combustion efficiency of an engine.

Figure 4A:
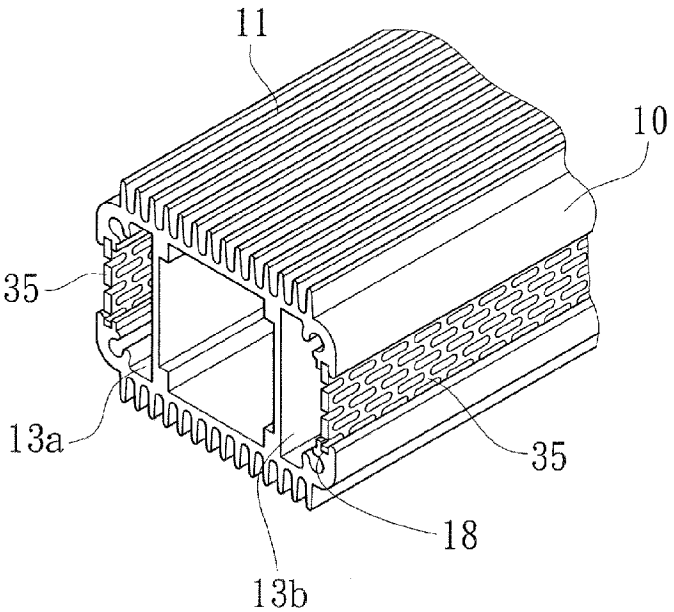
FIG. 4A is an assembled view of FIG. 4.
Figure 4:
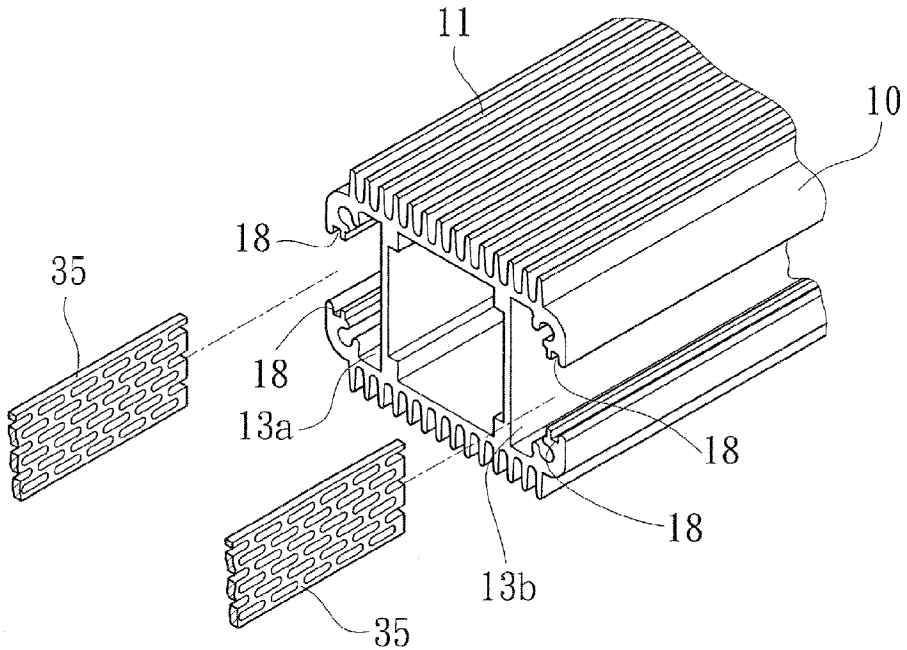
FIG. 4 is a perspective view of a fuel economizer according to another embodiment of the present invention with side boards detached from a housing of the economizer.

Referring to FIGS. 4 and 4A, another embodiment showing a different structure of the housing 10 of the economizer 1 is provided, wherein the secondary receiving compartments 13*a*, 13*b* each have an outer side open, and top and bottom of each of the secondary receiving compartments form grooves 18 that receive and fix an apertured side board 35 therebetween. Far infrared particles 30 are filled in each of the secondary receiving compartments 13*a*, 13*b*. Both ends of the housing 10 are closed by a front cover and a rear cover respectively. In this arrangement, the two side surfaces of the economizer are of excellent penetrability for fluid and surface area for direct contact between the fuel and the far infrared particles 30 is increase, thereby enhancing the activation of the fuel molecules.

Figure 5:
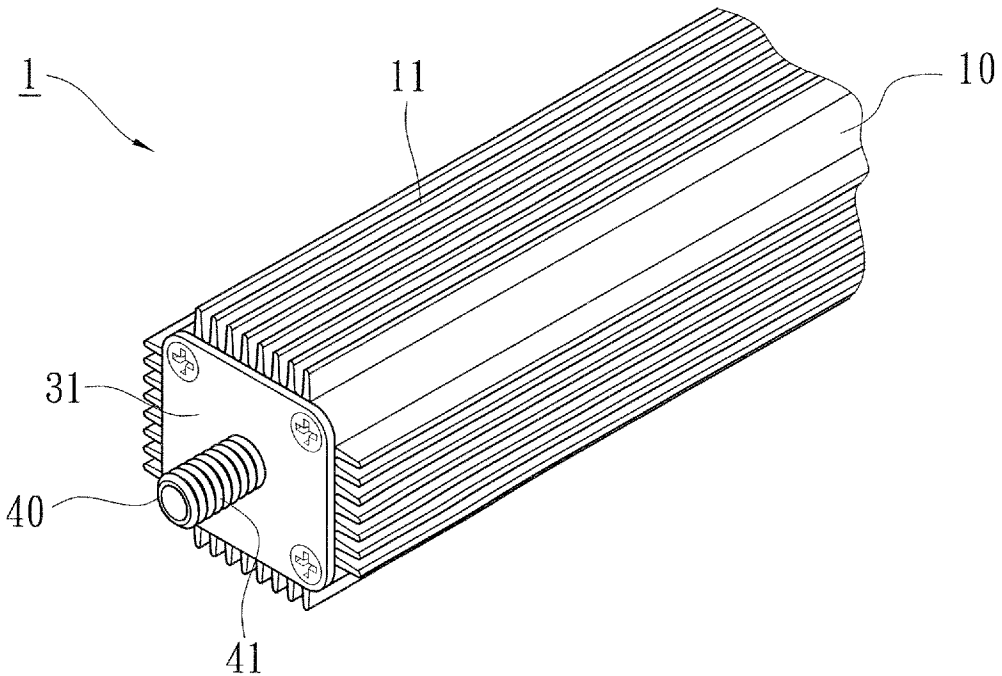
FIG. 5 is a perspective view of a fuel economizer according to a further embodiment of the present invention showing a modified covering member.

Referring to FIG. 5, a further embodiment is provided, wherein the front cover 31 (and/or the rear cover) forms an externally-threaded tube 40, which has an outside diameter forming an external thread 41 to allow the economizer 1 to be threadingly coupled to a fuel supply tube.

Figure 6:
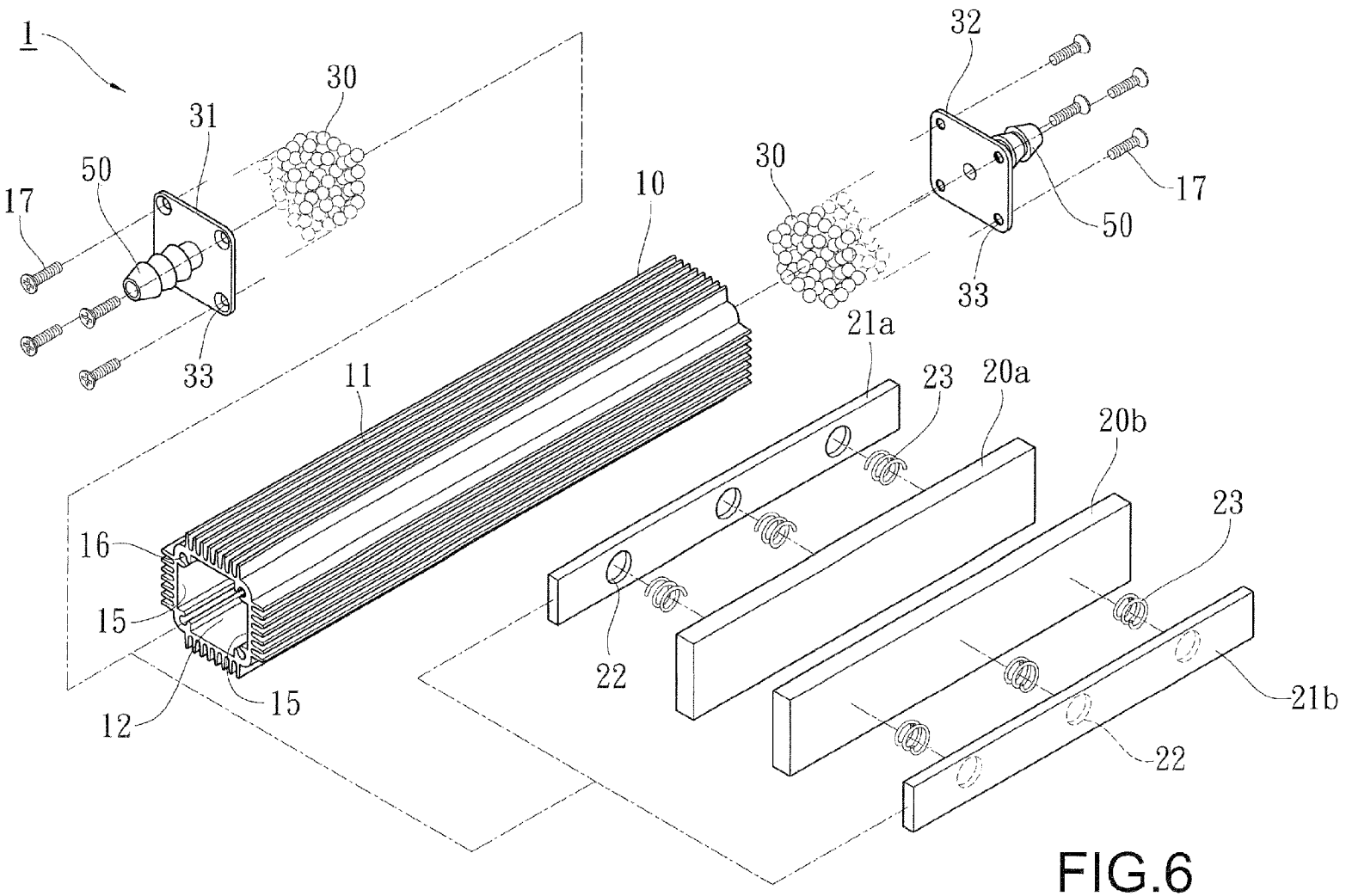
FIG. 6 is an exploded view of a fuel economizer according to a further embodiment of the present invention.
Figure 7:
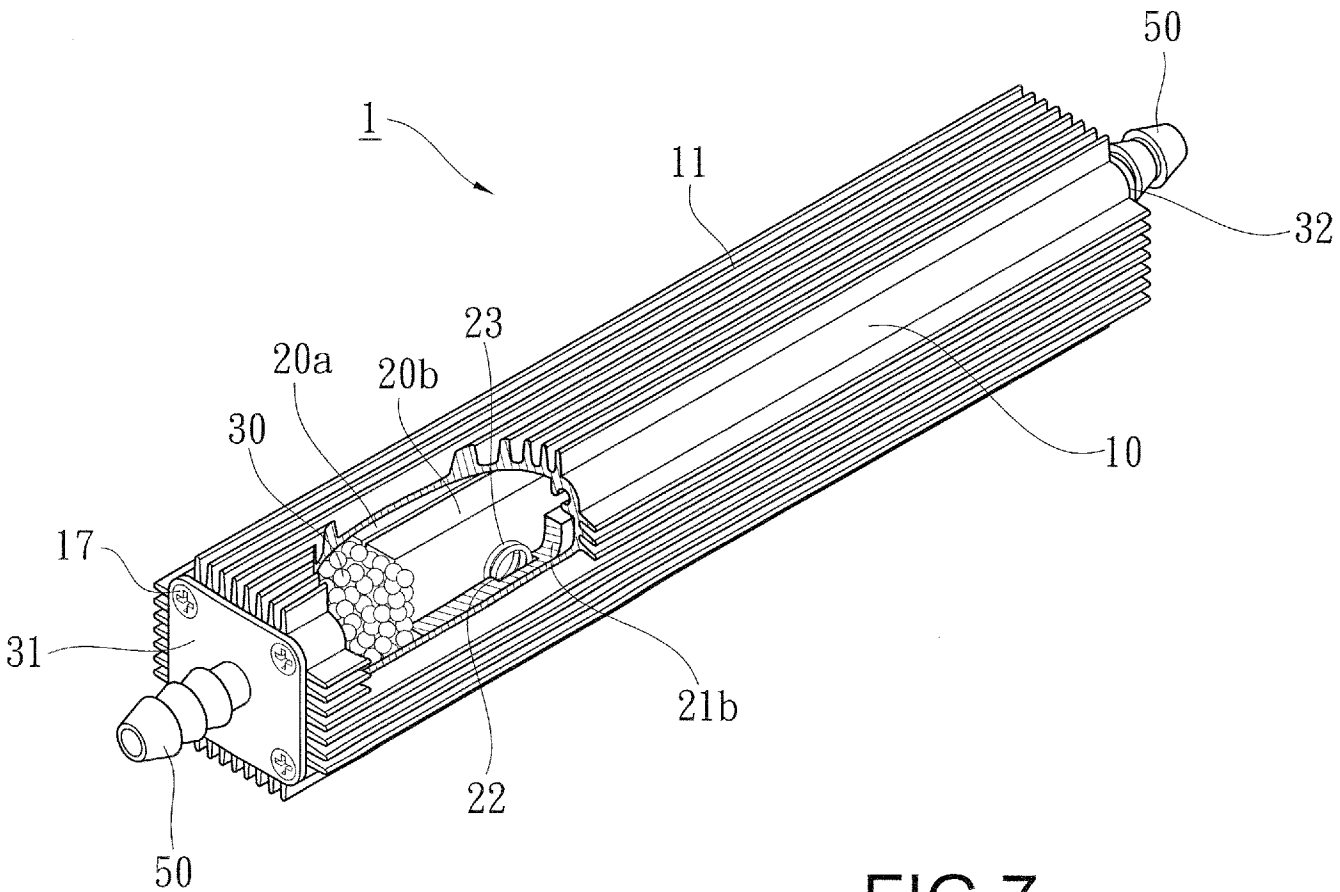
FIG. 7 is a perspective view, partially broken, of the fuel economizer of FIG. 6 in an assembled form.
Figure 8:
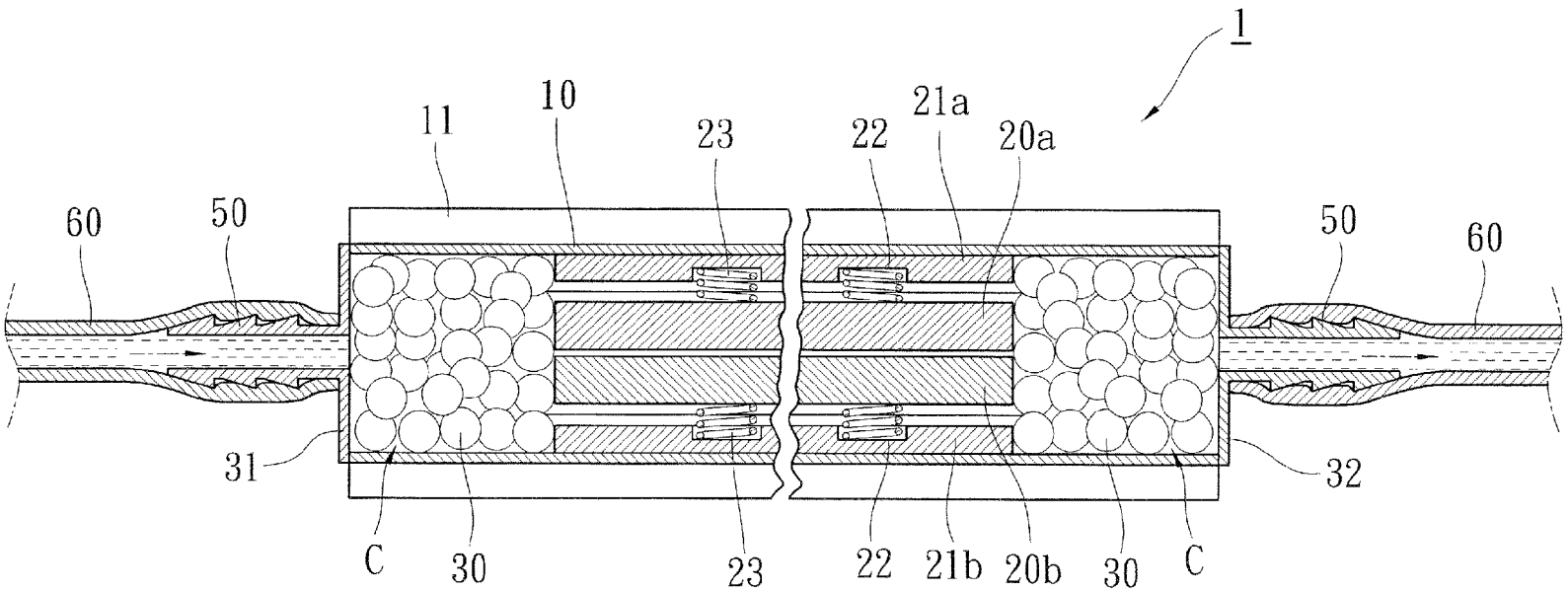
FIG. 8 is a cross-sectional view showing the fuel economizer of FIG. 6 connected to a fuel supply hose.

Referring to FIGS. 6-8, a further embodiment of the economizer 1 is shown, wherein the housing 10 has an interior space forming only a primary receiving compartment 12. Magnetic members 20*a*, 20*b*, of which portions having the same polarity are arranged to face each other, and ferrous boards 21*a*, 21*b* are provided in such a way that they have a length smaller than the housing 10, whereby the magnetic members 20*a*, 20*b*, with the ferrous boards 21*a*, 21*b* magnetically attracted and attached thereto, are set in the primary receiving compartment 12 with the portions thereof having the same polarity facing each other exactly the same as what disused previously. Again, the ferrous boards 21*a*, 21*b* form recessed cavities 22, each receiving and holding a resilient element 23. The resilient element 23 provides a force that separates each of the magnetic members 20*a*, 20*b* from the respective ferrous board 21*a*, 21*b* so as to form a hollow space therebetween. The magnetic members 20*a*, 20*b*, the ferrous boards 21*a*, 21*b*, and the resilient elements 23 that are assembled together are deposited into the primary receiving compartment 12, and due to the magnetic members 20*a*, 20*b* and the ferrous boards 21*a*, 21*b* being shorter than the housing 10, the deposition of the assembled magnetic members, ferrous boards, and resilient elements in the housing define, in both front and rear end portions inside the housing 10, unoccupied spaces C (see FIG. 8), in which far infrared particles 30 are subsequently filled. A front cover 31 and a rear cover 32, both having corners forming inner-threaded holes 33, receives bolts 17 that extend through the inner-threaded holes 33 to secure the front cover and the rear cover to the inner-threaded holes 16 of the housing 10. Both or any of the front cover 31 and the rear cover 32 forms a coupling tube 50, which is connectable with a hose 60 (see FIG. 8), whereby the supply of fuel is conducted through the hose 60 to have the fuel flowing through the magnetic members 20*a*, 20*b* by which the molecule structure is changed. Meanwhile, the fuel molecules are activated by the far infrared particles 30. Consequently, the combustion of fuel is made efficient and complete and the efficiency of engine is improved.

Figure 9:
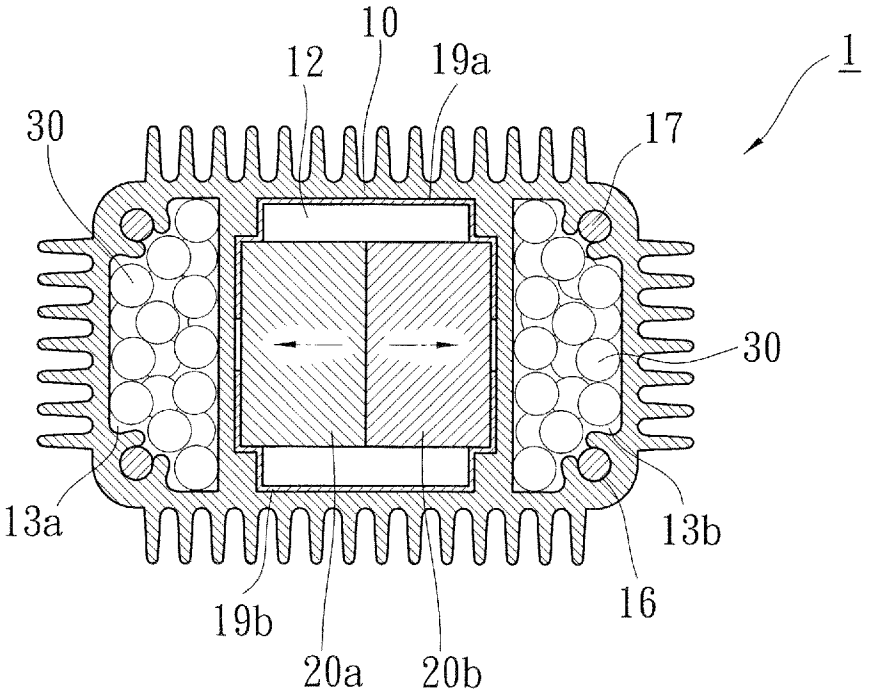
FIG. 9 is a cross-sectional view showing a fuel economizer according to yet a further embodiment of the present invention.

Referring to FIG. 9, yet a further embodiment of the economizer according to the present invention is provided. Similarly, a housing 10 is provided and has an interior space forming a primary receiving compartment 12, in which at least one metal board is set. In the embodiment shown in the drawing, two metal boards 19*a*, 19*b* are provided. Two magnetic members 20*a*, 20*b* are positioned against each other with the sides thereof carrying the same polarity opposing each other and are deposited between the two metal boards 19*a*, 19*b*, whereby the two magnetic members and the inside walls of the housing form spacing therebetween. In a preferred form, two secondary receiving compartments 13*a*, 13*b* are respectively formed on opposite sides of the primary receiving compartment 12 and far infrared particles 30 are filled in the two secondary receiving compartments 13*a*, 13*b*. Bolts 17 engaging inner-threaded holes 16 defined in opposite open ends of the housing 10 to secure a front cover and a rear cover to close the open ends to form the economizer 1. With such an arrangement, hollow spaces D and E are respectively formed above and below the two magnetic members 20*a*, 20*b* to allow the flow of a fluid therethrough, whereby strong and fast penetration of far infrared radiation from the far infrared particles 30 into the fluid, such as fuel, induce reaction with the fuel molecules to enhance activation of the fuel molecules, making the combustion of the fuel complete, or reaction can be induced between the far infrared radiation and water molecule, if the fluid is water, and with the water being used to cool an engine, indirect influence on the fuel can be made by which combustion efficiency of the engine is improved.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An economizer (1) comprising a housing (10), at least two magnetic members (20*a*, 20*b*) having sides of the same polarity facing each other, and at least one covering member (31, 32), and characterized in that:

the housing (10) has an interior space forming a primary receiving compartment (12), the housing (10) having at least one end forming an opening (14*a*, 14*b*), the end forming inner-threaded holes (16) in a circumferential edge, the covering member (31, 32) being attached to and closing the open end;

the primary receiving compartment (12) is delimited by two opposite end spaced walls each having an inside surface that is recessed to form a slot (15);

two magnetic members (20*a*, 20*b*) are arranged in such a way that the sides thereof having the same polarity are set to face each other to be received in the primary receiving compartment (12);

two metal boards (21*a* and 21*b*) are set in the primary receiving compartment (12) and are fitted in the slots (15);

a plurality of resilient elements (23) are mounted between the metal boards (21*a* and 21*b*) and the magnetic members (20a and 20*b*) in such a way that the resilient elements (23) provide a force to separate each of the magnetic members (20*a* and 20*b*) from a respective one of the metal boards (21*a* and 21*b*) so as to form a space (A) therebetween;

two secondary receiving compartments are respectively formed in the housing on opposite sides of the primary receiving compartment to receive and hold therein far infrared particles;

the covering member (31, 32) forms holes (33) in a circumferential edge, the covering member (31, 32) defining apertures (34); and the covering member (31, 32) is secured to the open end of the housing (10) with bolts (17) engaging the inner-threaded holes.

2. The economizer (1) according to claim 1, wherein the housing (10) has two ends, both forming an opening (14*a*, 14*b*).

3. The economizer (1) according to claim 1, wherein the housing (10) has one end that is open and an opposite end that is closed, the closed end forming apertures.

4. The economizer (1) according to claim 1, wherein the secondary receiving compartments (13*a*, 13*b*) have open outer sides, the secondary receiving compartments (13*a*, 13*b*) having top and bottom forming grooves (18) to receive and fix therebetween an apertured board (35).

5. The economizer (1) according to claim 1, wherein the housing (10) has outside surfaces on which a plurality of fin-like projection structures (11) is formed.

6. The economizer (1) according to claim 1, wherein the covering member (31, 32) forms an externally-threaded tube (40).

* * * * *